United States Patent [19]

Kusz

[11] 4,410,097

[45] Oct. 18, 1983

[54] CHILD RESISTANT PACKAGE

[75] Inventor: Maximillian Kusz, Waterville, Ohio

[73] Assignee: Owens-Illinois, Inc., Toledo, Ohio

[21] Appl. No.: 389,724

[22] Filed: Jun. 18, 1982

[51] Int. Cl.[3] ..... B65D 55/02

[52] U.S. Cl. ..... 215/214; 215/216; 215/206; 215/217

[58] Field of Search ..... 215/211, 206, 213, 214, 215/216, 217, 218

[56] References Cited

U.S. PATENT DOCUMENTS

| | | | |
|---|---|---|---|
| 3,173,565 | 3/1965 | Gray | 215/214 |
| 3,888,373 | 6/1975 | Gach et al. | 215/214 |
| 4,171,057 | 10/1979 | Gach | 215/211 |
| 4,351,442 | 9/1982 | Summers | 215/216 |

*Primary Examiner*—George T. Hall
*Attorney, Agent, or Firm*—J. R. Nelson; M. E. Click

[57] ABSTRACT

A child resistant package comprising a container and a closure. The container has an open end, a thread on the inner surface of the open end, diametrically opposed lugs on the outer surface of the open end having a radially extending surface. The closure has a top wall, a peripheral skirt and an annular wall spaced radially inwardly from the peripheral skirt, and having an external thread on the outer surface thereof interengaging the thread on the inner surface of the upper end of the closure. The skirt has radially engageable lugs extending radially inwardly from the skirt. The skirt is flexible such that the closure can be engaged with the container by interengagement of the threads and rotation of the closure in one direction until the lugs on the skirt engage the lugs on the container and the closure may be removed by radially compressing portions of the closure at about 90° between the lugs on the closure to disengage the lugs on the closure from the lugs on the container such that the closure can be removed by rotation relative to the container in the opposite direction.

18 Claims, 8 Drawing Figures

CHILD RESISTANT PACKAGE

This invention relates to child resistant closures.

BACKGROUND AND SUMMARY OF THE INVENTION

For safety purposes, it has been generally accepted and mandated by law in some jurisdictions that the closures and containers for medicines and chemicals be constructed to resist opening by children. In one type of child resistant package that is commonly used, the package comprises three components, namely, a closure, liner and container or vial. Such types are usually manipulated by an axial and rotating motion. It has also heretofore been suggested that child resistant packages be provided that are based upon a radial compression and rotation of the closure relative to the container.

Among the objects of the present invention are to provide a child resistant package that requires only a closure and container; which can be manipulated readily by disabled or elderly persons yet will function effectively to be child resistant.

In accordance with the invention, the child resistant package comprising a container and a closure. The container has an open end, a thread on the inner surface of the open end, diametrically opposed lugs on the outer surface of the open end having a radially extending surface. The closure has a top wall, a peripheral skirt and an annular wall spaced radially inwardly from the peripheral skirt, having an external thread on the outer surface thereof interengaging the thread on the inner surface of the upper end of the closure. The closure assumes a closed, safety position in which an annular sufrace on the closure engages an annular complementary surface on the container finish, to thereby seal the package. The skirt has radially engageable lugs extending radially inwardly from the skirt. The skirt is flexible such that the closure can be engaged with the container by interengagement of the threads and rotation of the closure in one direction unitl the lugs on the skirt engage the lugs on the container in the safety position, and the closure may be removed from that position by radially compressing portions of the closure skirt at about 90° between the lugs on the closure to disengage the lugs on the closure from the lugs on the container such that the closure can be removed by rotation relative to the container in the opposite direction. In the package there is provided a seal of the closure on the finish across inwardly chamfered, annular seal surfaces that correspond.

DESCRIPTION

Figure 1:
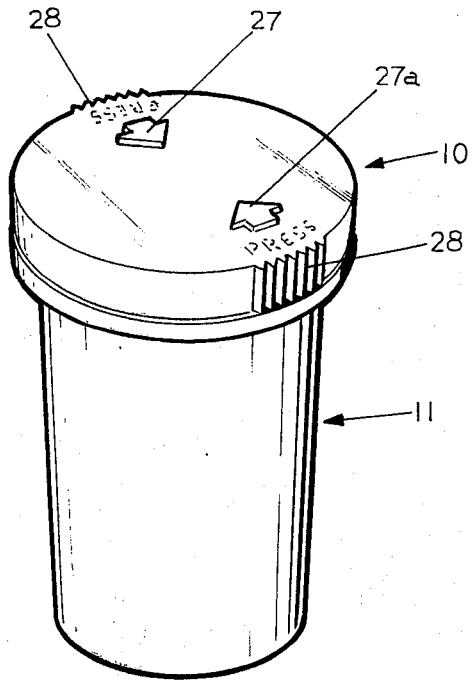
FIG. 1 is a perspective view of a child resistant package embodying the invention.
Figure 2:
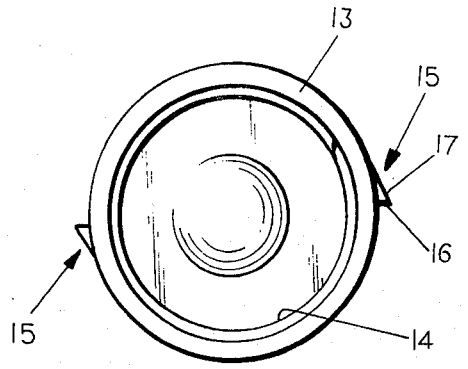
FIG. 2 is a plan view of a container forming part of the child resistant package.
Figure 3:
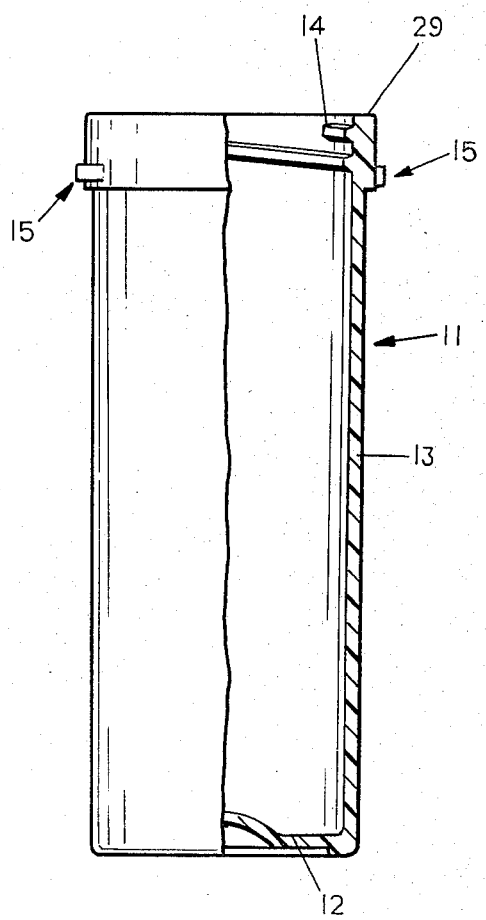
FIG. 3 is a part sectional elevational view of the container.
Figure 4:
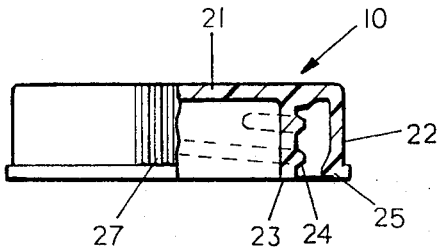
FIG. 4 is a part sectional elevational view of a closure forming part of the child resistant package.
Figure 7:
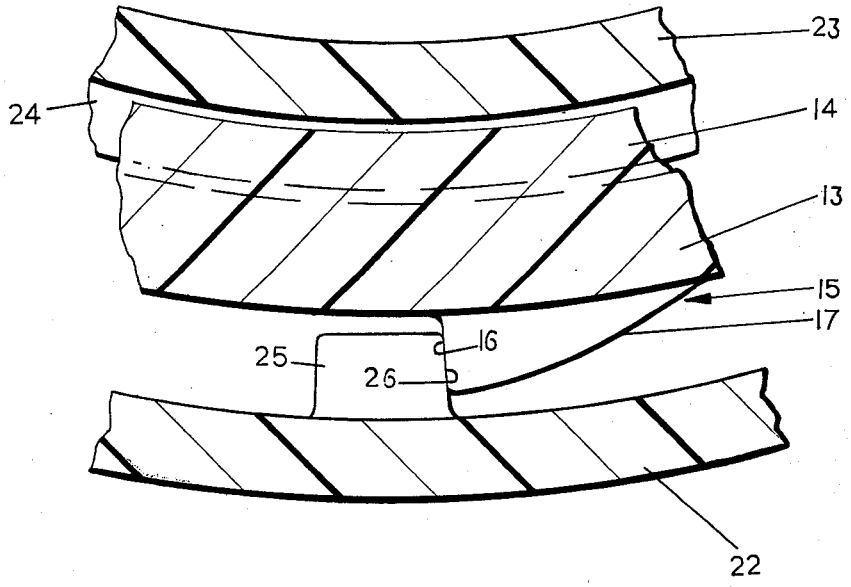
FIG. 7 is a fragmentary sectional view taken along the line 7—7 in FIG. 6.
Figure 8:
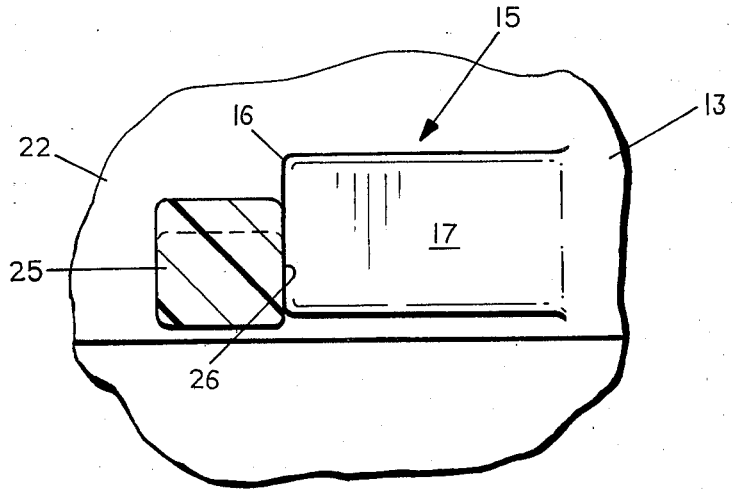
FIG. 8 is a fragmentary sectional view taken along the line 8—8 in FIG. 6.

Referring to FIG. 1, the child resistant package embodying the invention comprises a closure 10 and a container 11. The container or vial 11 is generally cylindrical and includes a bottom wall 12 and a side wall 13 with an open upper end. The container is formed with internal threads 14 at the upper end and diametrically opposed radially outwardly extending lugs 15 on the outer surface of the upper ends (FIGS. 2, 3). Each lug 15 includes a downwardly extending radial surface 16 and a cam surface 17 extending from the outer surface of the side wall of the container 10 to the surface 16 (FIGS. 4, 7, 8).

The closure 10 comprises a top wall 21 (FIGS. 4 and 5) and a peripheral skirt 22. In addition, the closure 10 includes an integral annular wall 23 spaced radially inwardly from the skirt 22 and extending downwardly from the inner surface of the top wall 21. The annular wall 23 has threads 24 on the outer surface thereof that are complementary to the threads 14 on the inner surface of the upper end of the container 10.

Figure 5:
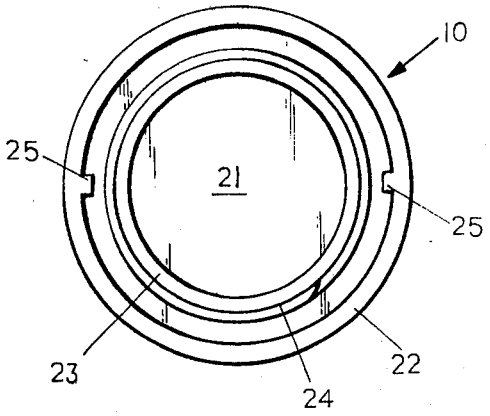
FIG. 5 is a bottom plan view of the closure.

The closure 10 further includes diametrically opposed radially inwardly extending lugs 25 on the inner surface of the skirt which are rectangular. Each lug 25 has a radial surface 26 adapted to engage surface 17 of a lug 15 of the container 11 (FIGS. 4, 5, 7). The skirt 22 is flexible so that the closure 10 may be compressed radially at 90° to the lugs 25 to flex the skirt 22 into an oval shape for disengagement of the lugs 25 on the closure 10 from the lugs 15 on the container, 11, as presently described. Indicia 27, 27*a* preferably in the form of arrows pointing radially inwardly are provided on the top wall 21 to indicate to the user the place where the skirt 22 should be compressed. In addition, knurled portions 28 for gripping and compressing the skirt are provided on the exterior of the skirt at the places where the compressive force should be applied (FIG. 1).

The closure 10 is made of plastic material such as polypropylene. The container is made of plastic such as polypropylene.

The closure 10 is applied to the container 11 by threading the closure 10 on the container 11. As the closure 10 moves downwardly axially due to the interengagement of the threads 24 on the closure 10 with the thread 14 on the container 11, the lugs 25 on the closure 10 are brought into engagement with the cam surfaces 17 of lugs 15 camming the lugs 25 of the closure 10 outwardly until the surface 26 of each lug snaps into engagement with a surface 16 of lug 15 (FIGS. 7, 8).

In order to remove the closure 10, the closure 10 is grasped at diametrically opposite portions compressing the skirt 22 radially inwardly to cause the skirt 22 to achieve a somewhat oval configuration so that the diametrically located lugs 25 on the closure 10 move radially outwardly out of engagement with the lugs 15 on the container 11 and the closure 10 can then be removed by rotation in the opposite direction.

Figure 6:
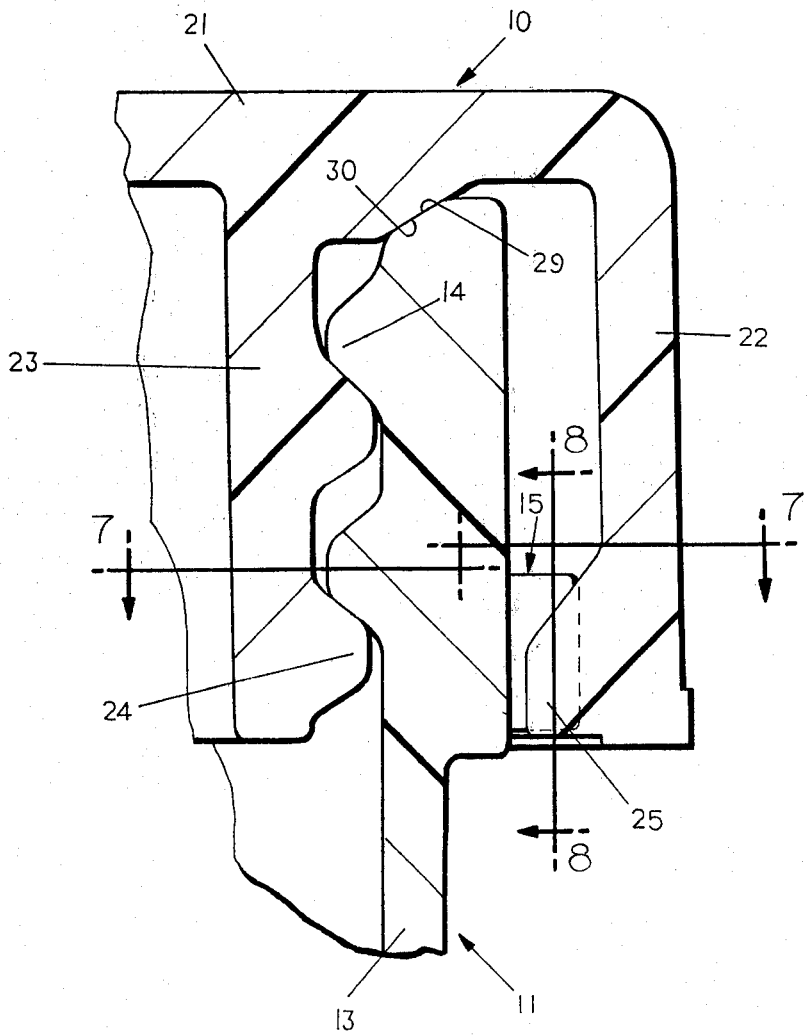
FIG. 6 is a fragmentary sectional elevational view of the child resistant package on an enlarged scale.

As best seen in FIG. 6, when the closure 10 is applied to the container 11, an annular cam surface 29 at the upper end of the container at the juncture of the top rim portion and inner surface above the threads engages a complementary annular surface 30 provided on an annular taper on the inner surface of the top wall 21 of the closure 10 located between the inner wall 23 with the threads 24 and the inside of the outer skirt wall 22. The complementary surface 30 may be best disposed intermediate these two spaced apart, annular walls 22, 23 of the closure to provide a seal so that no additional liner is required.

It can thus be seen that there has been provided a child resistant package that requires only a closure or container and which can be manipulated readily by disabled or elderly persons yet will function effectively to be child resistant. The package further provides a seal without the need for an additional liner.

I claim:

1. A child resistant package comprising a container having an open end, a thread on the inner surface of the open end, a closure having a top wall, a peripheral skirt, an annular wall spaced radially inwardly from the peripheral skirt, said annular wall having an external thread on the outer surface thereof interengaging the thread on the inner surface of the upper end of the closure, said skirt and said closure having radially engageable means, said skirt being flexible such that the closure can be engaged with the container by interengagement of the threads and rotation of the closure in one direction until the radially engageable means engage and the closure may be removed by radially compressing portions of the closure at about 90° between the lugs on the closure to disengage the radially engageable means such that the closure can be removed by rotation relative to the container in the opposite direction.

2. The child resistant package set forth in claim 1 wherein said interengaging means on said closure comprises radially inwardly extending lugs, said interengaging means on said container comprising radially outwardly extending lugs thereon.

3. The child resistant package set forth in claim 2 wherein each said notch lug on said container has a downwardly extending radial surface and each said lug on the closure has a complementary surface.

4. The child resistant package set forth in claim 3 including a cam portion on said container extending from the outer surface thereof to said radial surface.

5. The child resistant package set forth in claim 1 wherein the upper end of said container and a portion of said closure at the undersurface of the top wall have complementary surfaces that are interengaged to form a seal.

6. The child resistant package set forth in claim 1 including indicia means on the closure indicating to the user the portions of the closure which are to be compressed.

7. The child resistant closure set forth in claim 6 wherein said indicia means comprise arrows on the closure extending radially inwardly.

8. The child resistant package set forth in claim 1 including means on the closure to facilitate radial compression of said portions of the closure.

9. A child resistant package comprising a container having an open end, a thread on the inner surface of the open end, diametrically opposed lugs on the outer surface of the open end having downwardly extending radial surfaces, each said lug on said container including a cam portion on said container extending from the outer surface thereof to said radial surface, a closure having a top wall, a peripheral skirt, an annular wall spaced radially inwardly from the peripheral skirt, said annular wall having an external thread on the outer surface thereof interengaging the thread on the inner surface of the upper end of the closure, said skirt having radially engageable lugs extending radially inwardly from the skirt, said skirt being flexible such that the closure can be engaged with the container by interengagement of the threads and rotation of the closure in one direction until the lugs on the skirt engage the lugs on the container and the closure may be removed by radially compressing portions of the closure at about 90° between the lugs on the closure to disengage the lugs on the closure from the lugs on the container such that the closure can be removed by rotation relative to the container in the opposite direction.

10. The child resistant package set forth in claim 6 wherein the upper end of said container and a portion of said closure at the undersurface of the top wall have complementary surfaces that are interengaged to form a seal.

11. The child resistant package set forth in claim 9 including indicia means on the closure indicating to the user the portions of the closure which are to be compressed.

12. The child resistant closure set forth in claim 11 wherein said indicia means comprise arrows on the closure extending radially inwardly.

13. The child resistant package set forth in claim 9 including means on the closure to facilitate radial compression of said portions of the closure.

14. A closure for a container having an open end, a thread on the inner surface of the open end, and diametrically opposed lugs on the outer surface of the open end, said closure having a top wall, a peripheral skirt, an annular wall spaced radially inwardly from the peripheral skirt, said annular wall having an external thread on the outer surface thereof adapted to interengage the thread on the inner surface of the upper end of the closure, said skirt having radially engageable lugs extending radially inwardly from the skirt, said skirt being flexible such that the closure can be engaged with the container by interengagement of the threads and rotation of the closure in one direction until the lugs on the skirt engage the lugs on the container and the closure may be removed by radially compressing portions of the closure at about 90° between the lugs on the closure to disengage the lugs on the closure from the lugs on the container such that the closure can be removed by rotation relative to the container in the opposite direction.

15. The closure set forth in claim 8 wherein a portion of said closure at the undersurface of the top wall has a surface that is adapted to interengage a portion of the container to form a seal.

16. The closure set forth in claim 14 including means on the closure indicating to the user the portions of the closure which are to be compressed.

17. The closure set forth in claim 16 wherein said indicia means comprise arrows on the closure extending radially inwardly.

18. The closure set forth in claim 14 including means on the closure to facilitate radial compression of said portions of the closure.

* * * * *